US005662185A

United States Patent [19]

Mackiewicz

[11] Patent Number: 5,662,185

[45] Date of Patent: Sep. 2, 1997

[54] DRIVE ASSEMBLY FOR RADIO-CONTROLLED CARS

[76] Inventor: Bruce Mackiewicz, 365 19th Ave., Brick Town, N.J. 08723

[21] Appl. No.: 412,320

[22] Filed: Mar. 29, 1995

[51] Int. Cl.[6] ..... B60K 17/00

[52] U.S. Cl. ..... 180/65.6; 180/56

[58] Field of Search ..... 180/56, 65.6, 65.7; 446/465, 456, 457, 469

[56] References Cited

U.S. PATENT DOCUMENTS

| | | | |
|---|---|---|---|
| 3,752,246 | 8/1973 | Sullivan | 180/56 |
| 5,338,247 | 8/1994 | Miles | 180/56 |

FOREIGN PATENT DOCUMENTS

| | | | |
|---|---|---|---|
| 1031194 | 5/1958 | Germany | 446/465 |
| 3047070 | 7/1982 | Germany | 446/457 |
| 2275206 | 8/1994 | United Kingdom | 446/465 |

*Primary Examiner*—Brian L. Johnson
*Assistant Examiner*—Frank Vanaman
*Attorney, Agent, or Firm*—Clifford G. Frayne

[57] ABSTRACT

A drive assembly mounted on the axle of a radio-controlled racing car, the drive assembly comprising in combination, an axle hub having a drive sleeve positioned therein, the drive sleeve having an extending geometric face cooperable with a ring bearing having a complimentary geometric aperture, mounted interiorily of a spur gear mounted on the axle, and a wheel hub having a drive sleeve secured therein having an extending geometric face cooperable with an exterior mounted ring bearing, having a complimentary geometric aperture, both the wheel hub, the drive sleeve and ring bearing mounted exteriorily of the spur gear, the geometrically-extending face of the complimentary drive sleeves cooperable with the geometric apertures of the ring bearing to provide positive, non-slippage rotation to the axle of the radio-controlled car.

4 Claims, 3 Drawing Sheets

DRIVE ASSEMBLY FOR RADIO-CONTROLLED CARS

BACKGROUND OF THE INVENTION

1. Field of the Invention

The present invention relates generally to radio-controlled race cars and more specifically to a drive assembly for radio-controlled racing cars which eliminates slippage between the drive motor/transmission and the wheels of the radio-controlled racing car.

2. Description of the Prior Art

Radio-controlled racing cars are an increasingly popular form of entertainment and are manufactured on a scale relative to full size cars of approximately 1/8th scale.

The cars are typically powered by an electric motor or gas motor. For a general description of the type of car with which we are dealing, see U.S. Pat. No. 3,752,246 to Sullivan. The radio-controlled cars are typically powered by an electric motor or gas motor mounted proximate the rear axle with a series of gear drives transmitting the axial rotation of the motor to the rear axle and hence to the rear tires.

Since the motor operates at relatively high RPM, it is desirable not to have any slippage with respect to the transmission of the axial rotation to the rear axle. Past practice required two thrust bearing washers to be positioned on opposing sides of a spur gear having radially mounted bearings, the spur gear rotatably mounted on the axle with the thrust bearing washers having a nipple protrusion in outwardly facing engagement with the axle hub and the wheel hub. These thrust bearing washers would be in tight friction engagement on opposing sides of the spur drive and radially mounted bearings. The rotation of the spur gear would thus frictionally cause the rotation of the thrust bearing washer which would transmit this rotation via the nipple protrusion to the axle hub and wheel hub with the radio-controlled vehicle's wheel being secured to the wheel hub and thus causing the rotation thereof.

This construction allowed for a relatively inexpensive manner in which to transmit the axial rotation of the motor to the wheels, however, the thrust bearing washer would oftentimes wear or fail to engage the respective axle hub or wheel hub and thus cause slippage in the transmission of axial rotation to the radio-controlled vehicle's wheel.

Cost of manufacture involving intricate machining prevented or hindered the development of a better or improved manner in which the axial rotation of the motor could be transmitted to the wheels of the radio-controlled vehicle. Applicant has developed a simple, cost-effective method of improving the manner in which the axial rotation of the motor is transmitted to the wheels of the radio-controlled vehicles which utilizes an axle hub and wheel hub of the vehicle, but substitutes the prior art thrust bearing washer with ring bearings which interlock with a pair of cooperative sleeves which are secured in the wheel hub and the axle hub respectively, the ring bearings and sleeves interlocking by means of a interlocking geometric shape between the sleeve and the respective ring bearing.

OBJECTS OF THE INVENTION

An object of the present invention is to provide for a novel precision drive assembly for radio-controlled cars which eliminates slippage between the power source and the wheels of the radio-controlled car.

A still further object of the present invention is to provide for a novel precision drive assembly for radio-controlled cars in which there is positive engagement between the spur gear and radially-mounted bearings and the axle hub and wheel hub.

A still further object of the present invention is to provide for a novel precision drive assembly for radio-controlled cars in which the wheel hub and axle hub of the drive assembly can be utilized with the drive assembly of Applicant's invention.

SUMMARY OF THE INVENTION

A drive assembly mounted on the axle of a radio-controlled racing car, the drive assembly comprising in combination, an axle hub having a drive sleeve positioned therein, the drive sleeve having an extending geometric face cooperable with a ring bearing having a complimentary geometric aperture, mounted interiorily of a spur gear mounted on the axle, and a wheel hub having a drive sleeve secured therein having an extending geometric face cooperable with an exterior mounted ring bearing, having a complimentary geometric aperture, both the wheel hub, the drive sleeve and ring bearing mounted exteriorily of the spur gear, the geometrically-extending face of the complimentary drive sleeves cooperable with the geometric apertures of the ring bearing to provide positive, non-slippage rotation to the axle of the radio-controlled car.

BRIEF DESCRIPTION OF THE DRAWINGS

These and other objects of the present invention will become evident particularly when taken with the following drawings wherein.

DETAILED DESCRIPTION OF THE DRAWINGS

Figure 1:
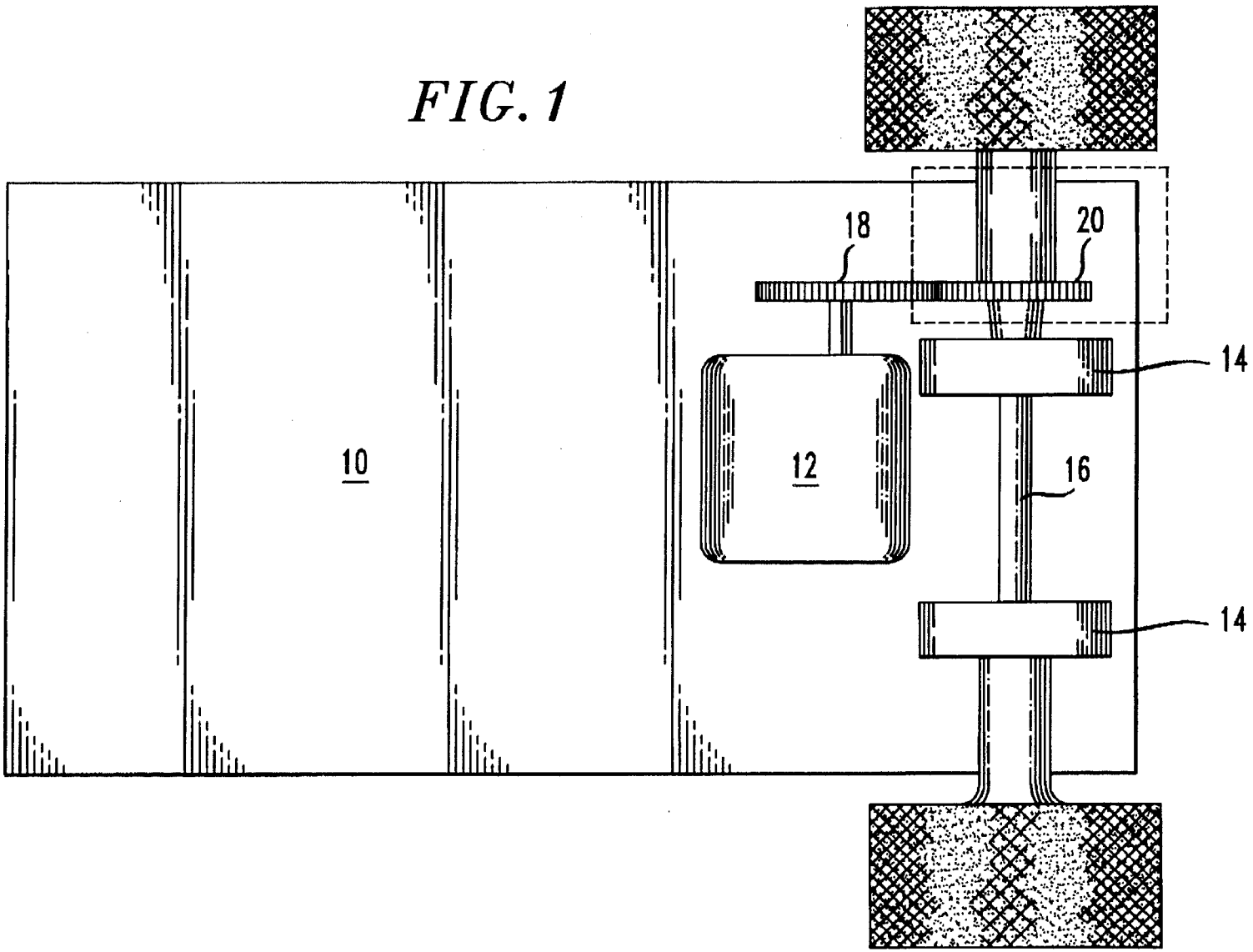
FIG. 1 is a top schematic view of a radio-controlled car body to illustrate the relative relationship of that portion of the drive assembly to which Applicant's invention relates.

Referring to FIG. 1, there is illustrated a top schematic view of a base 10 of a radio-controlled car. Base 10 would support the wheels, radio receiver and body of the radio-controlled car, those items not being shown in this particular illustration. Proximate the rear end of base 10 would be a support means for a motor 12 which would supply the power to the rear axle. Normally, there would be positioned on base 10, a pair of support pillars 14 rearwardly of the electric motor for support of the rear axle 16. In this particular illustration, motor 12 transmits its axial rotation to the axle by means of a drive gear 18 engaged with a spur gear 20 mounted on axle 16. This illustrates the simplest form of transmission of power from the motor to the axle. In many more sophisticated radio-controlled cars, there may be a plurality of intermeshing gears, in series, before the axial rotation is actually communicated to the spur gear 20;

however, for our purposes, Applicant's invention centers about the spur gear 20 and its transmission of axial rotation to the wheels. As such, the dotted outline surrounding the right rear axial drive structure is illustrated in FIG. 2 which is a side exploded view of the area outlined in FIG. 1.

Figure 2:
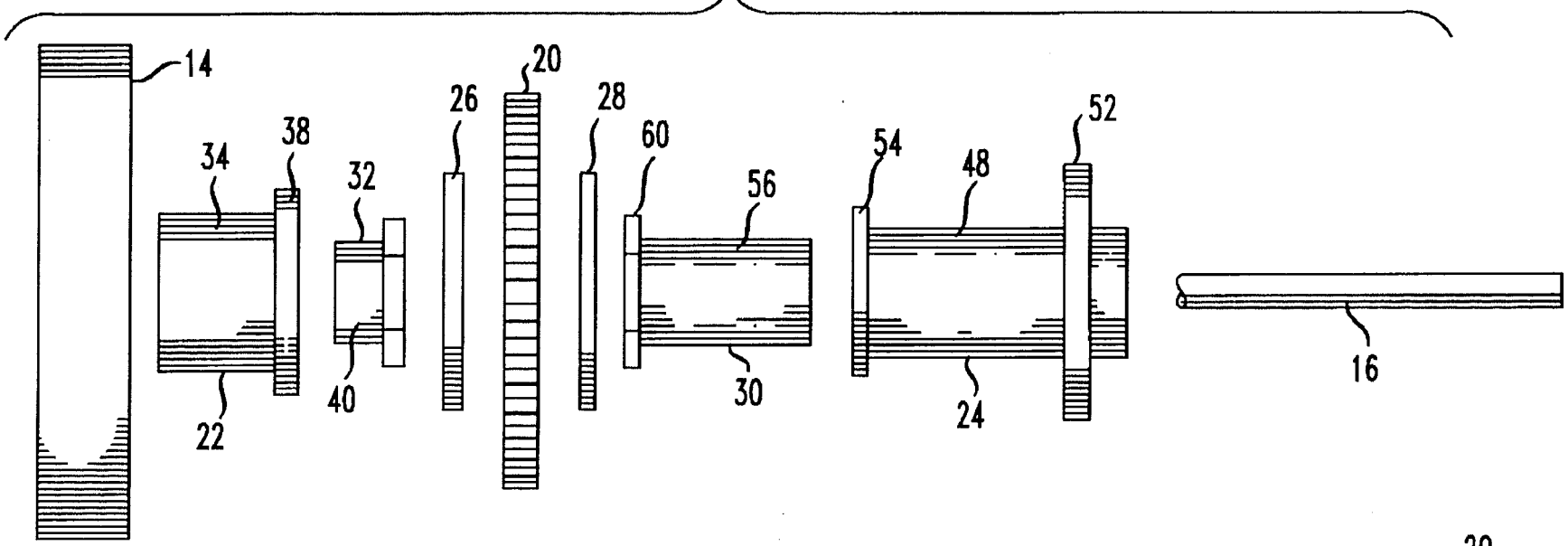
FIG. 2 is an exploded view of the drive and axle assembly.

In the exploded view illustrated in FIG. 2, there is shown axle 16 upon which would be mounted spur gear 20, axle hub 22, wheel hub 24 and inner ring bearing 26 and outer ring bearing 28. Two additional elements are illustrated in FIG. 2, an outer drive ring sleeve 30 associated with wheel hub 24 and an inner drive ring sleeve 32 associated with axle hub 22.

Figures 3, 4, 5, 6, 7, 8:
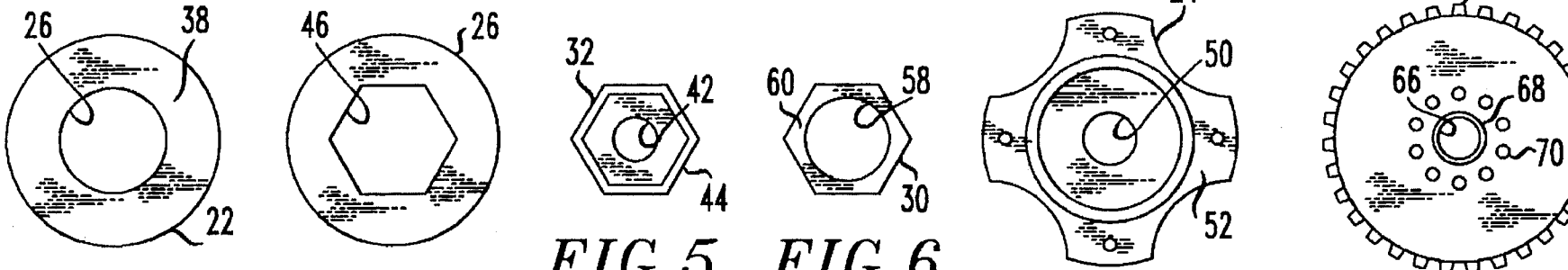
FIG. 3 is a front view of the axle hub.
FIG. 4 is a front view of the inner ring bearing associated with the axle hub.
FIG. 5 is a front view of the drive sleeve associated with the axle hub.
FIG. 6 is a front view of the drive sleeve associated with the wheel hub.
FIG. 7 is a front view of the wheel hub.
FIG. 8 is a front view of the spur gear.

FIG. 3 is front view of axle hub 22 which shows that it has a generally cylindrical body 34 having a tubular concentric throughbore 36 passing therethrough and an annular flange 38 positioned about its outer or wheel facing end. FIG. 5 is a front view of the drive sleeve 32 associated with axle hub 22. Drive sleeve 32 has a cylindrical body 40 whose outer diameter is equal to the diameter of throughbore 36 of axle hub 22. Drive sleeve 32 has a throughbore 42 to accommodate axle 16. Drive sleeve 32 has an annular flange 44 on its outwardly facing end. As illustrated in FIG. 2, flange 44 on drive sleeve 32 is six sided or hexagonal in shape. The cylindrical body member 40 of drive sleeve 32 is designed to be inserted into throughbore 36 of axle hub 22 and secured thereto either by a pin or by adhesive. In this configuration, axle hub 22 presents an outwardly engaging face having a circular annular flange 38 and an extended hexagonal face 44.

Referring to FIG. 4, there is a front view of the axle hub inner ring bearing 26. Inner ring bearing 26 is generally circular in nature and performs the function of the ring bearings as described with respect to the prior art. However, inner ring bearing 26 has an aperture 46 which is complimentary to hexagonal face 44 on drive sleeve 32. In the instant illustration, that complimentary aperture being six sided or hexagonal and of a dimension to permit the hexagonal face 44 of drive sleeve 32 to fit within aperture 46. In operation, as described more fully hereafter, inner ring bearing 26 would be in frictional engagement with spur gear 20.

Moving to the opposite side of spur gear 20, the same type of construction is applied to wheel hub 24.

FIG. 7 is a front view of wheel hub 24 which when taken in conjunction with the side view illustrated in FIG. 2, illustrates that wheel hub 24 has a cylindrical body member 48 having a throughbore 50 and proximate its outer facing end, has an annular flange in the form of outwardly extending fingers 52 for mounting of the wheel of the radio-controlled car. At its inwardly facing end, wheel hub 24 has a circular annular flange 54.

FIG. 6 is a front view of the drive sleeve 30 associated with wheel hub 24 and when taken in conjunction with the side view illustrated in FIG. 2 illustrates that the drive sleeve 30 associated with wheel hub 24 has a cylindrical body member 56 having throughbore 58 therethrough and on its inwardly facing end, has an annular flange 60 which, as illustrated, is six sided or hexagonal in shape. The throughbore 58 within drive sleeve 30 accommodates axle 16.

Again, drive sleeve 30 is designed to be slidably inserted into throughbore 50 of wheel hub 24 and secured thereto by means of a pin and/or adhesive. In this construction, the inner facing end of wheel hub 24 then presents a circular, annular flange 54 having a six-sided or hexagonal face extending therefrom. Outer ring bearing 28 would be of the same configuration as inner ring bearing 26. Outer wheel hub bearing 28 would be frictionally engaged with spur gear 20 and wheel hub 24 and its associated drive sleeve would be positioned such that the hexagonal face 60 would engage the hexagonal opening 46 of outer ring bearing 28.

FIG. 8 is a front view of spur gear 20. Spur gear 20 has an aperture 66 which is complimentary with the circumference of axle 16. An annular bearing 68 supports spur gear 20 on axle 16. Radially mounted about aperture 66 and partially encapsulated by spur gear 20 are a plurality of ball bearings 70 which are freely rotatable in their mounting within spur gear 20. The spherical portion of each ball bearing extends beyond the planar side surfaces of spur gear 20 and are in contact with inner ring bearing 26 and outer ring bearing 28.

When the drive assembly is positioned on axle 16, the inner end of axle hub 22 would be flush with support pillar 14 and the assembly would be maintained in position by means of a lock nut and washer threadedly secured on axle 16, outwardly of wheel hub 24. The assembly would be secured such that inner ring bearing 26 and outer ring bearing 28 were in tight frictional engagement with the spherical surface portions of ball bearings 70 mounted in spur gear 20 and inner ring bearing 26 and outer ring bearing 28 would be in positive engagement with the axle hub 22 and wheel hub 24 as a result of the interlocking engagement with the extended geometrical faces of axle hub sleeve 32 and wheel hub sleeve 30.

Power from the motor 12 would be transmitted to spur gear 20 which would rotate freely about axle 16. The rotation of spur gear 20 would be transmitted to inner ring bearing and outer ring bearing 26 and 28, respectively, by the ball bearings 70 mounted radially in spur gear 20. As a result of the geometrical interlocking of the inner ring bearing 26 and outer ring bearing 28 with axle hub sleeve 32 and wheel hub sleeve 30, the rotation is transmitted to the axle hub, wheel hub and axle and hence to the wheels of the radio-controlled car.

Figure 9:
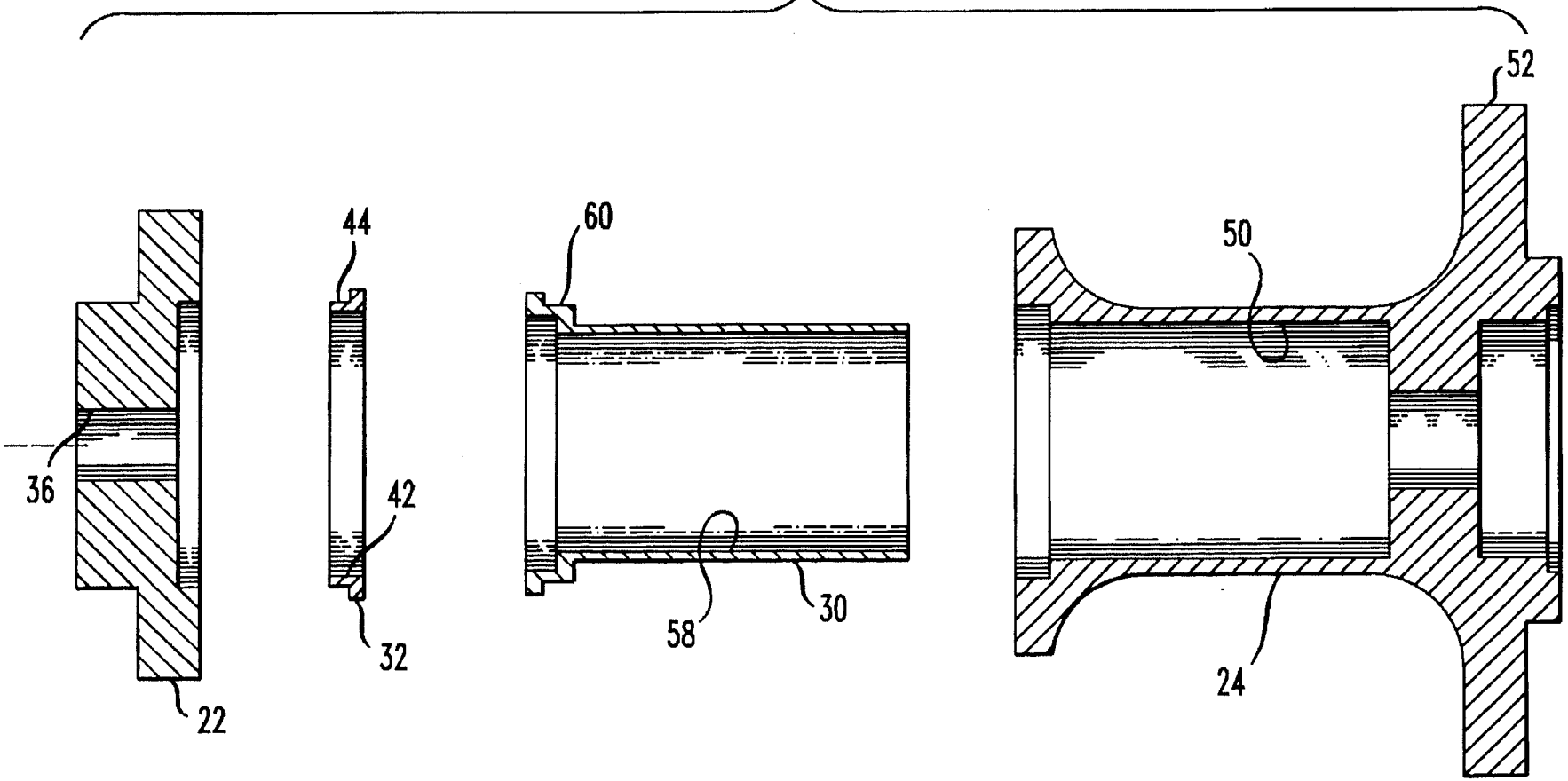
FIG. 9 is an exploded view of the wheel hub and sleeve assembly and axle hub and sleeve assembly associated therewith.

FIG. 9 is a side exploded view illustrating the cooperation of the axle hub with its associated sleeve and the wheel hub with its associated sleeve. It will be noted that the throughbores of the respective sleeves 30 and 32 do not have to be complimentary with the actual diameter of the axle 16 in that wheel hub 24 and axle hub 22 can be fabricated such that only a portion of the throughbores 50 and 36 are actually complimentary to the diameter of the axle 16. The present embodiment has been illustrated with a geometric interlock in the shape of a hexagon. Other geometric shapes for the interlock between hubs and ring bearings will also accomplish the same result so that the geometric shape is one of choice based on cost and ease of fabrication.

While the present invention has been described with respect to the preferred embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. A drive assembly for a racing car, wherein said racing car has a motor, a drive axle, and a gear assembly for transmission of rotational energy from said motor to said axle, said drive assembly comprising:

a spur gear having planar sides, said spur gear mounted on said axle, in communication with said gear assembly, said spur gear having a plurality of spherical ball bearings radially disposed about said axle and partially encapsulated by said spur gear, a spherical portion of said ball bearings exposed on said planar side of said spur gear;

an inner ring bearing and an outer ring bearing disposed on opposing sides of said spur gear, said inner ring bearing and said outer ring bearing in contact with said exposed spherical portion of said ball bearings, said inner ring bearing and said outer ring bearing having an axially disposed geometric aperture therethrough;

an axle hub disposed adjacent said inner ring bearing, said axle hub having a cylindrical body and axial throughbore, said axle hub having an annular flange disposed toward said inner ring bearing;

a drive sleeve comprising a cylindrical body having a throughbore, said cylindrical body of said drive sleeve complimentary to said throughbore of said axle hub, said cylindrical body of said drive sleeve having a geometric flange complimentary to said geometric aperture of said inner ring bearing, said drive sleeve slidably securable in said throughbore of said axle hub;

a wheel hub having a cylindrical body, having a throughbore therethrough, mounted on said axle exteriorly of said outer ring bearing, said wheel hub having a means for mounting a wheel and tire of said racing car;

a second drive sleeve having a cylindrical body, and a throughbore therethrough, said second drive sleeve having a geometrically-shaped flange disposed toward said outer ring bearing, said second drive sleeve slidably securable in said throughbore of said wheel hub and said geometrically-shaped flange complimentary with and engageable with said geometric aperture of said outer ring bearing;

means for securing said drive assembly on said axle.

2. A drive assembly in accordance with claim 1 wherein said geometric flange of said drive sleeve and said complimentary geometric aperture of said inner ring bearing have at least three sides.

3. A drive assembly in accordance with claim 1 wherein said geometric flange of said second drive sleeve and said geometric aperture of said outer ring bearing have at least three sides.

4. A drive assembly for a racing car having a motor, an axle, and a gear assembly for transmission of rotational energy of said motor to said axle, said drive assembly mounted on said axle and comprising:

an axle hub comprising a generally cylindrical body having a throughbore therethrough and an annular flange, said axle hub throughbore for receipt of a generally cylindrical drive sleeve having a throughbore, said drive sleeve having a geometrically-shaped flange extending outwardly from said axle hub and engageable with an inner ring bearing positioned between said axle hub and a spur gear, said inner ring bearing having a geometrically-shaped aperture complimentary with said geometrically-shaped flange of said drive sleeve;

a wheel hub being generally cylindrically shaped having a throughbore for receipt of a second drive sleeve having a generally cylindrically-shaped body and having a throughbore, said drive sleeve having an extending geometrically-shaped flange for cooperation with an outer ring bearing, said outer ring bearing having a geometric aperture therethrough cooperative with said geometric flange of said drive sleeve, said inner ring bearing and said outer ring bearing positioned on opposing sides of a spur gear for transmission of said rotational energy from said motor to said axle hub, wheel hub, and axle of said racing car.

* * * * *